US006347466B1

(12) United States Patent
Lackner et al.

(10) Patent No.: US 6,347,466 B1
(45) Date of Patent: Feb. 19, 2002

(54) METHOD FOR MODIFYING THE TENSION OF A CANVAS

(75) Inventors: John R. Lackner, San Jose; Mark D. Russell, Hollister, both of CA (US)

(73) Assignee: Media Arts Group, Inc., Morgan Hill, CA (US)

( * ) Notice: Subject to any disclaimer, the term of this patent is extended or adjusted under 35 U.S.C. 154(b) by 0 days.

(21) Appl. No.: 09/858,310

(22) Filed: May 15, 2001

Related U.S. Application Data

(60) Provisional application No. 60/273,120, filed on Mar. 1, 2001.

(51) Int. Cl.[7] ..... D06C 3/08

(52) U.S. Cl. ..... 38/102.4; 38/102; 38/102.91

(58) Field of Search ..... 38/102.4, 102.2, 38/102.21, 102.91; 101/127.1; 160/371, 374.1, 378; 428/200, 409, 542.2

(56) References Cited

U.S. PATENT DOCUMENTS

| | | | | |
|---|---|---|---|---|
| 1,933,565 A | * | 11/1933 | Pampaian et al. | |
| 3,096,194 A | * | 7/1963 | Kliman | |
| 3,258,376 A | * | 6/1966 | Klimann | |
| 3,632,701 A | | 1/1972 | Devitt et al. | |
| 3,766,872 A | | 10/1973 | Krieger | |
| 3,872,208 A | | 3/1975 | Brown et al. | |
| 4,052,521 A | | 10/1977 | Ferrari | |
| 4,156,399 A | | 5/1979 | Fieux | |
| 4,330,586 A | | 5/1982 | Fieux | |
| 4,462,174 A | | 7/1984 | Messerschmitt | |
| 4,620,382 A | * | 11/1986 | Sallis | 38/102.91 X |
| 4,720,406 A | | 1/1988 | Dixon | |
| 4,756,714 A | | 7/1988 | Hendrix et al. | |
| 4,934,974 A | * | 6/1990 | Jarosz et al. | 38/102.91 X |
| 5,324,392 A | * | 6/1994 | Tate et al. | |
| 5,900,276 A | | 5/1999 | Sooklaris | |
| 5,957,310 A | | 9/1999 | Mitchell | |

OTHER PUBLICATIONS

Copy of an article by Paul MacFarland entitled "Stretching Fine Art Canvas," consisting of pp. 100, 102, 104, 106, 108, 110, 112, 114, 116, and 118 from the Oct. 2000 issue of *Professional Furniture Merchant*.

Copy of an article by Fred M. Lamb entitled "Conditioning: Relieving those stresses," consisting of pp. 19, 21 and 22 from the Oct. 2000 issue of *Modern Woodworking*, and copies of the front cover and the title page.

* cited by examiner

*Primary Examiner*—Ismael Izaguirre
(74) *Attorney, Agent, or Firm*—Jones, Day, Reavis & Pogue

(57) ABSTRACT

A method includes steps for modifying tensile stresses in an unpainted canvas that is mounted on a frame under applied tensile stresses. The canvas is formed of material that can undergo heat-shrinking when at or above a thermoplastic shrinking temperature, and can undergo heat-softening when at or above a thermoplastic softening temperature. The method includes heating the canvas to a temperature at or above the thermoplastic shrinking temperature and the thermoplastic softening temperature. The method further includes maintaining the canvas at a temperature at or above the thermoplastic shrinking and softening temperatures. This induces heat-shrinking, and thereby increases the tensile stresses in any portions of the canvas in which the applied tensile stresses are less than the opposing stresses of the heat-shrinking. This also induces heat-softening, and thereby decreases the tensile stress in any portions of the canvas in which the applied tensile stresses are greater than the opposing stresses of the heat-shrinking. The method further includes subsequently cooling the canvas to a temperature below the thermoplastic shrinking and softening temperatures, whereby the canvas becomes set in a condition of modified tensile stresses.

21 Claims, 4 Drawing Sheets

METHOD FOR MODIFYING THE TENSION OF A CANVAS

This application claims the benefit of U.S. Provisional Application No. 60/273,120, filed Mar. 1, 2001.

FIELD OF THE INVENTION

This invention relates to methods of modifying the mounting tension of an artist's canvas.

BACKGROUND OF THE INVENTION

An artist's canvas is produced by mounting a canvas under tension on a rigid frame. Such canvas is known to develop sags or puckers. This is due to the applied tension being insufficient or nonuniformly distributed throughout the canvas. A common method of removing the sags and puckers is to use a frame constructed from stretcher bars that have mortised corners. Wedge-shaped tenons in the mortises are used to expand the frame to adjust the tension of the canvas.

SUMMARY OF THE INVENTION

The present invention comprises a method of modifying tensile stresses in an unpainted canvas that is mounted on a frame under applied tensile stresses. The canvas is formed of material that can undergo heat-shrinking when at or a above a thermoplastic shrinking temperature, and can undergo heat-softening when at or above a thermoplastic softening temperature. The method comprises heating the canvas to a temperature at or above the thermoplastic shrinking temperature and the thermoplastic softening temperature. The method further comprises maintaining the canvas of a temperature at or above the thermoplastic shrinking and softening temperatures. This induces heat-shrinking, and thereby increases the tensile stresses in any portions of the canvas in which the applied tensile stresses are less than the opposing stresses of the heat-shrinking. This also induces heat-softening, and thereby decreases the tensile stresses in any portions of the canvas in which the applied tensile stresses are grater than the opposing stresses of the heat-shrinking. The method further comprises subsequently cooling the canvas to a temperature below the thermoplastic shrinking and softening temperatures, whereby the canvas becomes set in a condition of modified tensile stresses.

In a preferred embodiment, the canvas is maintained free of any softening agent throughout the heating and maintaining steps. The frame is maintained without dimensional adjustment throughout the heating and maintaining steps. The material has warp yarns formed of a first component that can undergo heat-shrinking when at or above the thermoplastic shrinking temperature, and can also undergo heat-softening when at or above the thermoplastic softening temperature. An equal number of weft yarns are formed of the first component. The first component is preferably polyester. The material further includes a second component that does not heat-shrink at the thermoplastic shrinking temperature. The second component is preferably cotton. The frame comprises four strainer bars connected together by fasteners to form fixed joints. Alternatively, the frame comprises four stretcher bars connected together by mortised joints that enable expansion of the frame. The canvas is fixed to the frame by fasteners in a permanent condition suitable for the canvas to be subsequently painted while fixed to the frame.

DESCRIPTION OF THE INVENTION

Figure 1:
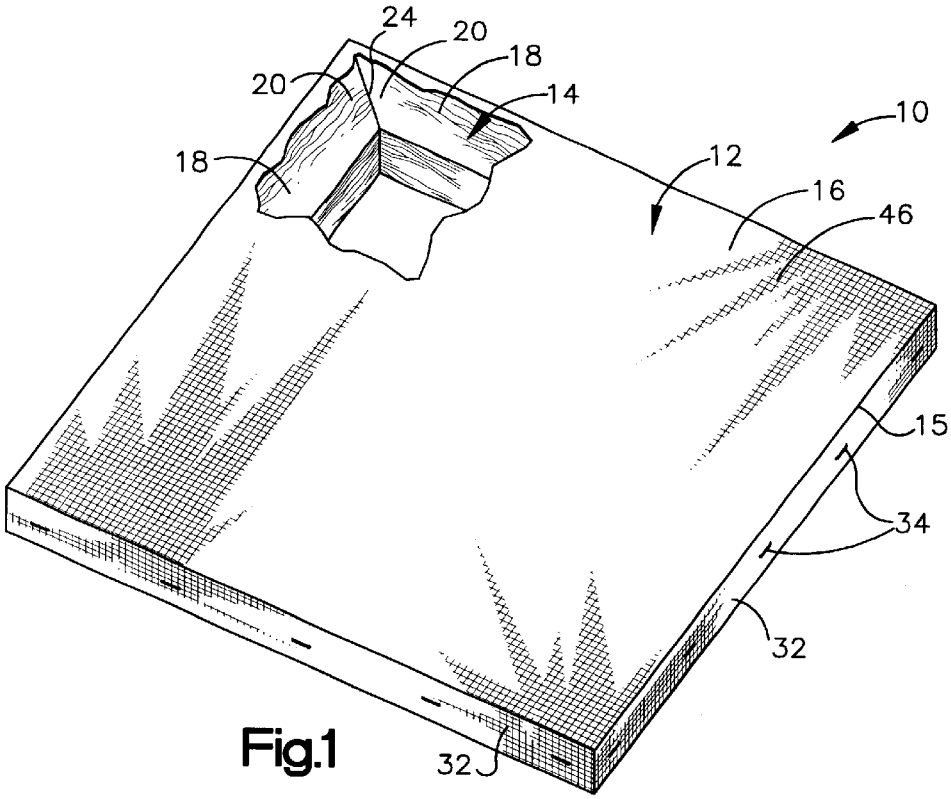
FIG. 1 is a perspective front view of a first embodiment of the present invention.
Figure 2:
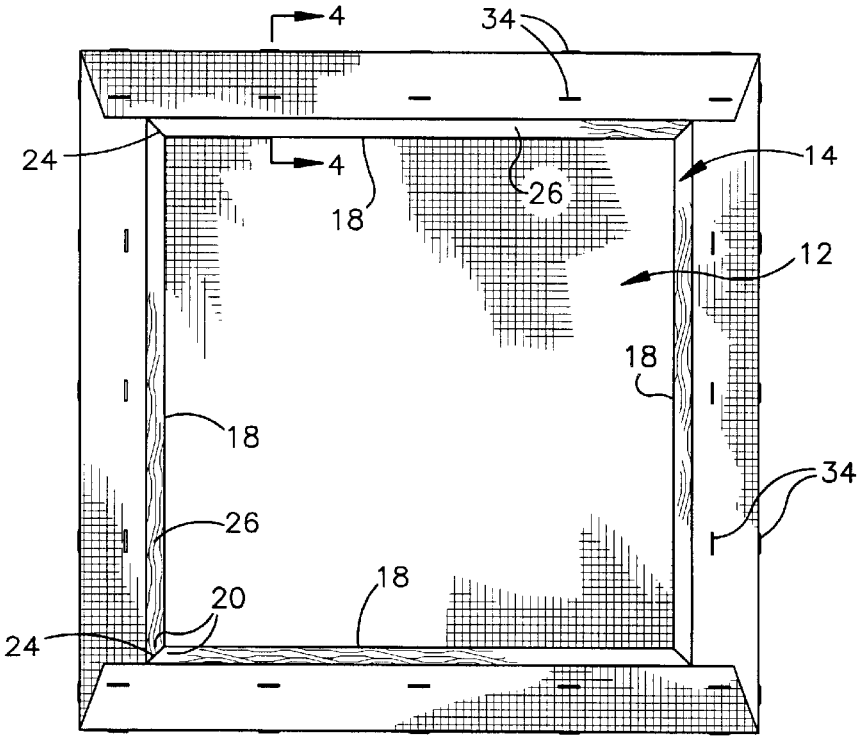
FIG. 2 is a rear view of the embodiment shown in FIG. 1.

An apparatus 10 comprising a first embodiment of the present invention is shown in FIGS. 1 and 2. The apparatus 10 includes a canvas 12 mounted under tension on a rigid frame 14, and is called an "artist's canvas." A peripheral edge 15 of the canvas 12 surrounds a front face 16 of the canvas 12. The front face 16 is flat due to the applied mounting tension. In the preferred embodiment, the front face 16 is free of an artist's coating and is suitable for being painted by an artist.

Figure 3:
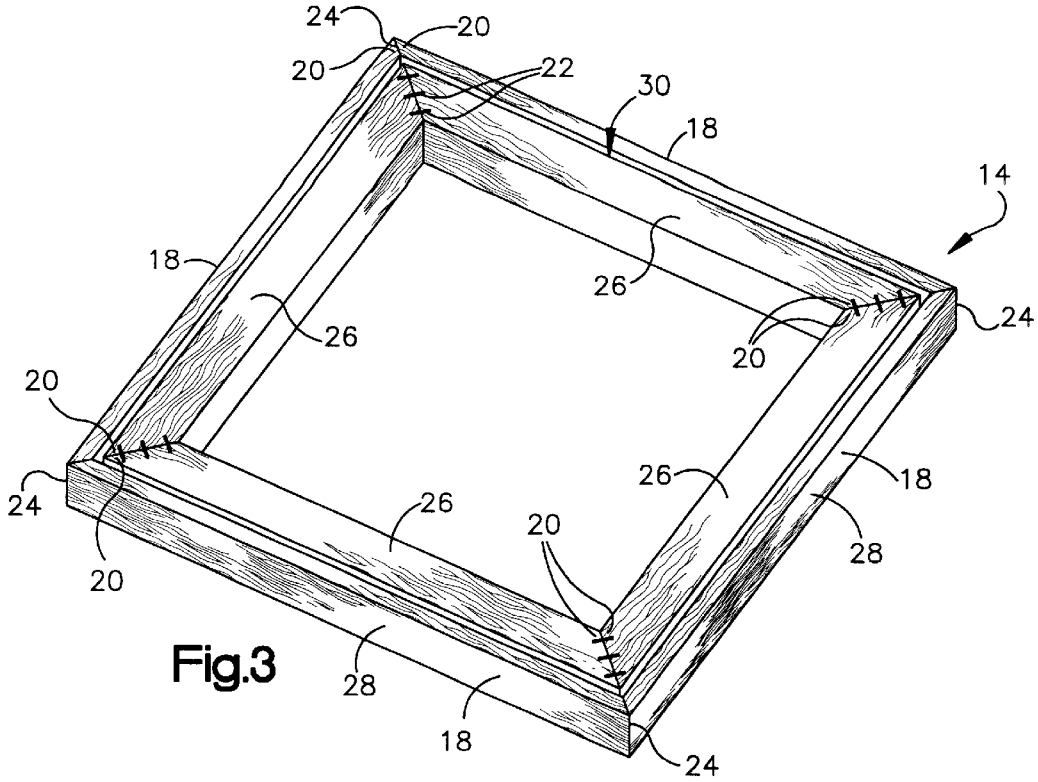
FIG. 3 is a perspective rear view of a part of the embodiment shown in FIG. 1.

Portions of the frame 14 are shown in FIGS. 1 and 2. The frame 14 is shown more fully in FIG. 3, The frame 14 includes four wooden strainer bars 18 having mitered ends 20. The mitered ends 20 are fastened together with staples 22 to form miter joints 24. The joints 24 are fixed. Specifically, the frame does not have a re-tensioning mechanism for adjusting the joints to modify the mounting tension of the canvas 12. The frame 14 is thus nonadjustable. Four co-planar rear surfaces 26 of the frame 14, as well as four orthogonal peripheral surfaces 28, can receive staples for attaching the canvas 12 (FIG. 2) to the frame 14. Along the rear surface 26 of the frame 14 extends a groove 30 into which a portion of the canvas 14 (FIG. 2) can be tucked.

Figure 4:
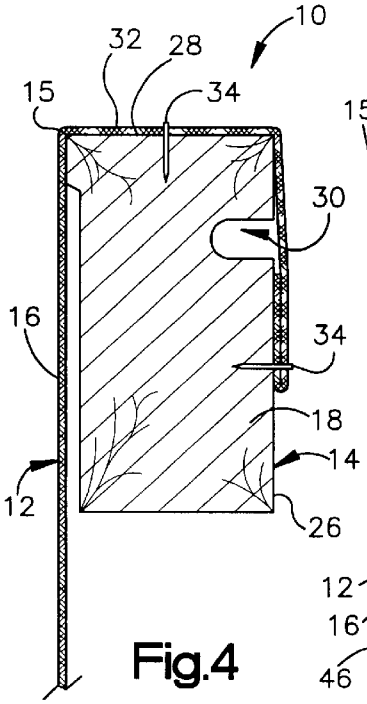
FIG. 4 is a sectional view taken on line 4—4 of FIG. 2.
Figure 5:
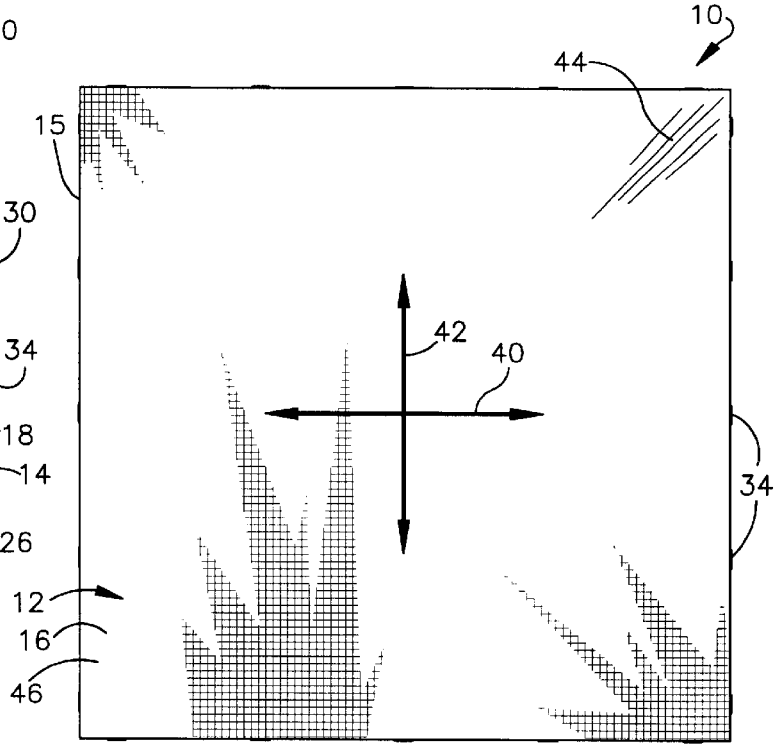
FIG. 5 is a front view of the embodiment shown in FIG. 1.

The canvas 12 is mounted on the frame 14 in the configuration shown in FIG. 4. Peripheral flaps 32 of the canvas 12 are stretched about the frame 14 under applied tension and are permanently fastened to the strainer bars 18 with staples 34. As shown in FIG. 5, the peripheral edge 15 surrounds the front face 16 of the canvas 12 upon which a picture (not shown) can be painted.

Referring to FIG. 5, the applied tension produces a distribution of tensile stresses throughout the front face 16. These tensile stresses includes stress components acting in directions extending across the front face 16 between the opposite sides of the frame 14, as indicated by the arrows 40 and 42, and initially keep the front face 16 flat. However, the tensile stresses in certain areas of the front face 16 may be undesirably low or may decrease over time. Furthermore, the tensile stresses in certain areas may be nonuniform or may become nonuniform. Such areas can develop a distortion, such as a pucker 44. Another example of a distortion is a sag (not shown).

According to the present invention, the artist's canvas 10 is prepared according to a process that prevents or alleviates such distortions 44 by modifying the tensile stresses in the front face 16. The tensile stresses are modified to be more uniform and closer to an optimal value. Specifically, the material 46 of the canvas 12 in the preferred embodiment comprises warp yarns and weft yarns of polyester. Polyester is a thermoplastic, and has a shrinking temperature at or above which it can heat-shrink. Polyester also has a softening temperature at or above which it can heat-soften. The number of polyester warp yarns preferably equals the number of polyester weft yarns. The material 46 further comprises warp yarns and well yarns of cotton. Cotton does not heat-shrink at the shrinking temperature of polyester, and does not heat-soften at the softening temperature of polyester. In this embodiment, the material 46 comprises about 30% cotton and about 70% polyester. The material 46 may have an acrylic surface coating (not shown) to provide the front face 16 with a desired surface texture.

Figure 6:
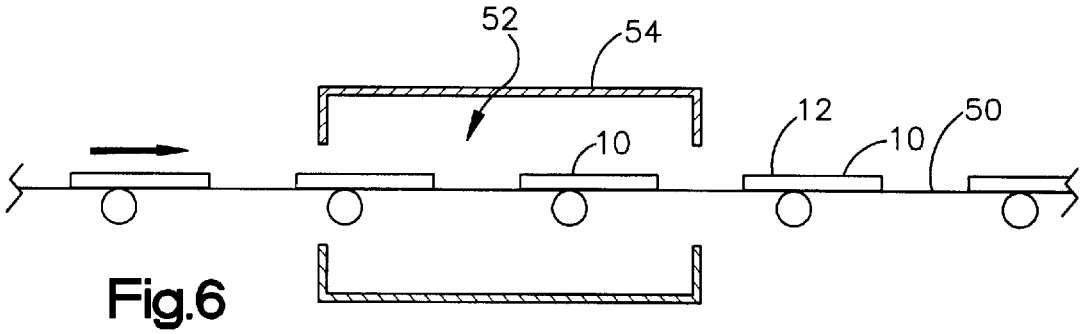
FIG. 6 is a schematic view of an apparatus used in a process according to the present invention.

The process starts with a heating step. As shown in FIG. 6, the artist's canvas 10 rests on a conveyer belt 50. The conveyer belt 50 conveys the artist's canvas 10 through a chamber 52 of an oven 54. The oven chamber 52 has a temperature that is at or above the shrinking temperature and the softening temperature of the polyester yarn. Within the oven chamber 52, the canvas 12, preferably the entire canvas 12, is heated to an elevated processing temperature that is at or above the shrinking temperature and the softening temperature. Preferably, the oven temperature is about 390° F., and the artist's canvas 10 is heated in the chamber 52 for about 45 seconds. As the canvas 10 is conveyed forward, this time period starts when the canvas 12 enters the chamber 52 and ends when the canvas 12 leaves the chamber 52. This causes the canvas 12 to reach a temperature of about 220° F.

Tho canvas 12 is maintained at the elevated processing temperature. At the elevated processing temperature, heat-shrinking can and does occur in those portions of the canvas 12 in which the applied tensile stresses were initially less than opposing heat-shrinking stresses. This causes the tensile stresses in those portions to increase. The increased tension alleviates distortions, such as the pucker 44 (FIG. 5).

Additionally, at the elevated processing temperature, heat-softening decreases the tensile stresses in those portions of the canvas 12 in which the applied tensile stresses were initially greater than the opposing heat-shrinking stresses. Consequently, through the combination of heat-shrinking and heat-softening, stresses approach an equilibrium level and becomes more uniform.

Next, the artist's canvas 10 is conveyed out of the oven chamber 52 and is cooled, preferably by merely allowing the artist's canvas 10 to cool to room temperature. The temperature of the canvas 12 is thus reduced to a temperature that is below both the shrinking and softening temperatures. Consequently, heat-shrinking and heat-softening ceases, and the canvas 12 is set in a condition of modified, more uniform tensile stresses.

Preferably, no liquid, mist or vapor is applied to the artist's canvas 10 during the heating, maintaining and cooling steps. For example, no softening agent in applied. Also, the frame 14 (FIG. 1) is not dimensionally adjusted the heating and maintaining steps.

The invention can thus be applied to a canvas 12 having both overly stressed portions and insufficiently stressed portions. The process renders the canvas 12 more uniformly stressed by relieving the overly stressed portions and tightening the insufficiently stressed portions. The process can also be applied to a canvas 12 having only overly stressed portions. In such a canvas 12, all portions are loosened, and the stresses also become more uniform. The process can further be applied to a canvas 12 having only portions with insufficient stresses with a value of zero. In such a canvas 12, all portions are tightened, and the stresses also become more uniform.

Figure 7:
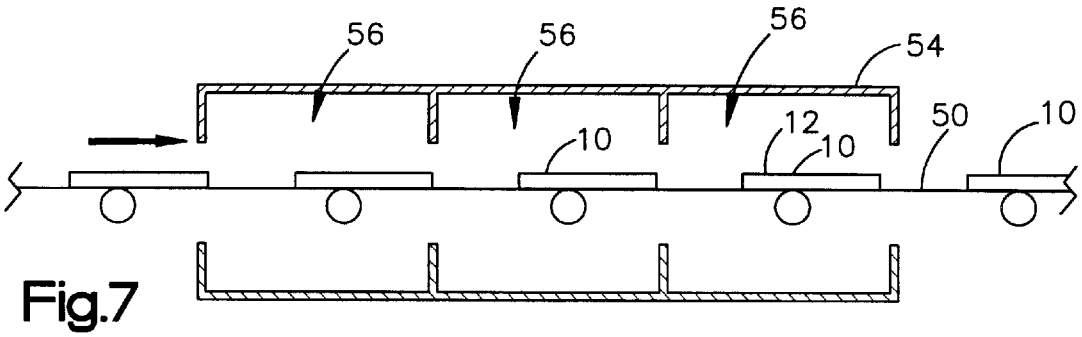
FIG. 7 is a schematic view of an apparatus used in a various the process.

FIG. 7 illustrates a variation of the invention. In the heating and the maintaining steps, the artist's canvas 10 is conveyed through a plurality of oven chambers 56. Each successive oven chamber 56 has a successively higher temperature.

Figure 8:
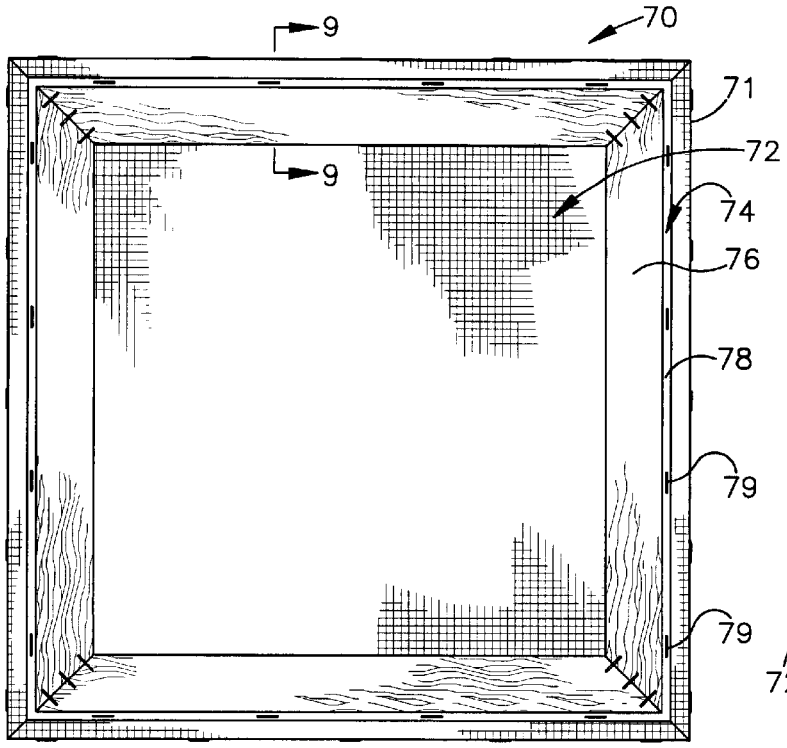
FIG. 8 is a rear view of a second embodiment of the present invention.
Figure 9:
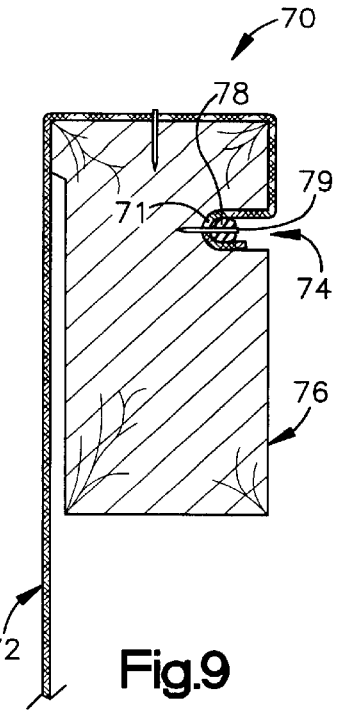
FIG. 9 is a sectional view taken on line 9—9 of FIG. 8.

As shown in FIG. 4 with reference to the artist's canvas 10 in the first embodiment, a peripheral flap 32 of the canvas 12 is stapled to the rear surfaces 26 and the peripheral surfaces 28 of the frame 14. In contrast, as shown in FIGS. 8 and 9 with reference to an artist's canvas 70 in a second embodiment, a peripheral flap 71 of a canvas 72 is pulled into a groove 74 of a frame 76. The frame 76 of the second embodiment is similar to the frame 14 (FIG. 4) of the first embodiment. The flap 71 is retained within the groove 74 by a rubber strip 78 that is fastened with staples 79 into the groove 74. The canvas 72 is processed through the steps of heating, maintaining and cooling as described above.

Figure 10:
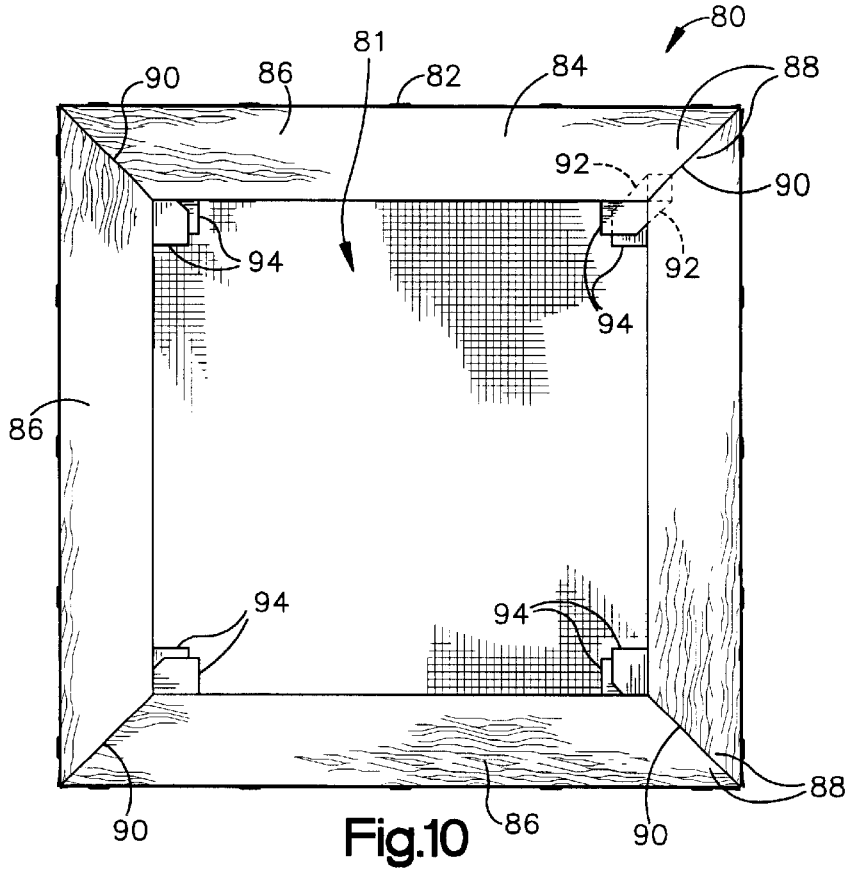
FIG. 10 is a rear view of a third embodiment of the present invention.

A third embodiment of an artist's canvas 80 constructed in accordance with the present invention is illustrated in FIG. 10. A canvas 81 is fastened with staples 82 to a frame 84. The frame 84 comprises four wooden stretcher bars 86 having mitered ends 88. The mitered ends 88 meet at joints 90. Each joint 90 has two mortises 92 and two tenons 94 that can be used to expand the frame 84 to re-tension the canvas 80. The canvas 80 is processed through the steps of heating, maintaining and cooling as described above.

The invention has been described with reference to preferred embodiments. Those skilled in the art will perceive improvements, changes and modifications. Such improvements, changes and modifications are intended to be within the scope of the claims.

What is claimed is:

1. A method of modifying tensile strength stresses in an unpainted canvas mounted on a frame under applied tensile stresses, the canvas being formed of material that can undergo heat-shrinking when at or above a thermoplastic shrinking temperature, and can undergo heat-softening when at or above a thermoplastic softening temperature, said method comprising:

heating the canvas to a temperature at or above said thermoplastic shrinking temperature and said thermoplastic softening temperature;

maintaining the canvas at a temperature at or above said thermoplastic shrinking temperature and said thermoplastic softening temperature to induce heat-shrinking and thereby to increase the tensile stresses in any portions of the canvas in which said applied tensile stresses are less than the opposing stresses of said heat-shrinking, and also to induce heat-softening and thereby to decrease the tensile stresses in any portions of the canvas in which said applied tensile stresses are greater than said opposing stresses of said heat-shrinking; and subsequently cooling the canvas to a temperature below said thermoplastic shrinking temperature and said thermoplastic softening temperature, whereby the canvas becomes set in a condition of modified tensile stresses.

2. The method of claim 1 wherein said heating step includes heating the entirety of the canvas to a temperature at or above said thermoplastic shrinking temperature and said thermoplastic softening temperature.

3. The method of claim 1 wherein the canvas is maintained free of any softening agent throughout said heating and maintaining steps.

4. The method of claim 1 wherein the frame is maintained without dimensional adjustment throughout said heating and maintaining steps.

5. The method of claim 1 wherein said heating step includes conveying the canvas through an oven chamber having an oven temperature that is greater than said thermoplastic shrinking temperature and said thermoplastic softening temperature.

6. The method of claim 1 wherein said heating step includes conveying the canvas through a plurality of oven chambers, each successive oven chamber having a successively higher oven temperature.

7. The method of claim 1 wherein the material has a warp yarns formed of a first component that can undergo heat-shrinking when at or above said thermoplastic shrinking temperature and can undergo heat-softening when at or above said thermoplastic softening temperature, and has an equal number of weft yarns formed of the first component.

8. The method of claim 7 wherein the first component is polyester.

9. The method of claim 7 wherein the material further includes a second component that does not heat-shrink at said thermoplastic shrinking temperature.

10. The method of claim 9 wherein the second component is cotton.

11. The method of claim 1 wherein the canvas has a surface coating to provide a desired surface texture.

12. The method of claim 1 wherein the frame comprises four strainer bars connected together by fasteners to form fixed joints.

13. The method of claim 1 wherein the frame comprises four stretcher bars connected together by mortised joints the enable expansion of the frame.

14. The method of claim 1 wherein the canvas is fixed to the frame by fasteners in a permanent condition suitable for said canvas to be subsequently painted while fixed to said frame.

15. A method of modifying tensile stresses in an unpainted canvas mounted on a frame under applied tensile stresses, the canvas being formed of material that can undergo heat-shrinking when at or above a thermoplastic shrinking temperature, and can undergo heat-softening when at or above a thermoplastic softening temperature, said method comprising:

heating the canvas to a temperature at or above said thermoplastic shrinking temperature and said thermoplastic softening temperature;

maintaining the canvas at a temperature at or above said thermoplastic shrinking temperature and said thermoplastic softening temperature, whereby tensile stresses in the canvas are modified; and subsequently cooling the canvas to a temperature below said thermoplastic shrinking temperature and said thermoplastic softening temperature to set the canvas in a condition of modified tensile stresses.

16. The method of claim 15 wherein said heating step includes heating the entirety of the canvas to a temperature at or above said thermoplastic shrinking temperature and said thermoplastic softening temperature.

17. The method of claim 15 wherein the canvas is maintained free of any softening agent throughout said heating and maintaining steps.

18. The method of claim 15 wherein the material has warp yarns formed of a first component that can undergo heat-shrinking when at or above said thermoplastic shrinking temperature and can undergo heat-softening when at or above said thermoplastic softening temperature, and has an equal number of weft yarns formed of the first component.

19. The method of claim 18 wherein the material further includes a second component the does not heat-shrink at said thermoplastic shrinking temperature.

20. The method of claim 15 wherein the frame comprises four strainer bars connected together by fasteners to form fixed joints.

21. The method of claim 15 wherein the frame comprises four stretcher bars connected together by mortised joints that enable expansion of the frame.

* * * * *

UNITED STATES PATENT AND TRADEMARK OFFICE

CERTIFICATE OF CORRECTION

PATENT NO. : 6,347,466 B1 
DATED : February 19, 2002
INVENTOR(S) : John R. Lackner and Mark D. Russell It is certified that error appears in the above-identified patent and that said Letters Patent is hereby corrected as shown below:

Title page,
Item [57], ABSTRACT,
Line 16, after "tensile", "stress" should read -- stresses --

Column 1,
Line 26, after "or" delete "a"
Line 32, after "canvas", "of" should read -- at --
Line 40, after "stresses are", "grater" should read -- greater --

Column 2,
Line 11, "various" should read -- variation of --
Line 52, after "tensile stresses","includes" should read -- include --

Column 3,
Line 7, after "yarns and", "well" should read -- weft --
Line 29, "Tho" should read -- The --
Line 42, after "and", "becomes" should read -- become --
Line 53, after "agent", "in" should read -- is --
Line 65, after "stresses" add -- or stresses --

Column 4,
Line 33, after "tensile" delete "strength"

Column 5,
Line 10, after "material has" delete "a"
Line 29, after "joints", "the" should read -- that --

UNITED STATES PATENT AND TRADEMARK OFFICE

CERTIFICATE OF CORRECTION

PATENT NO. : 6,347,466 B1 
DATED : February 19, 2002
INVENTOR(S) : John R. Lackner and Mark D. Russell It is certified that error appears in the above-identified patent and that said Letters Patent is hereby corrected as shown below:

Column 6,
Line 29, after "component", "the" should read -- that --

Signed and Sealed this

Eleventh Day of February, 2003

JAMES E. ROGAN
*Director of the United States Patent and Trademark Office*